United States Patent [19]

Castiglia et al.

[11] Patent Number: 4,573,108

[45] Date of Patent: Feb. 25, 1986

[54] DECORATIVE LIGHTING SYSTEM

[76] Inventors: Robert Castiglia; Helen Castiglia, both of 7 Linden La., Shirley, N.Y. 11967

[21] Appl. No.: 665,999

[22] Filed: Oct. 26, 1984

[51] Int. Cl.[4] ..... A47G 33/16

[52] U.S. Cl. ..... 362/123; 339/157 C; 339/258 R; 362/122; 428/20

[58] Field of Search ..... 362/122, 123, 249, 252, 362/806; 339/157 C, 258 R; 428/18–20

[56] References Cited

U.S. PATENT DOCUMENTS

| | | | |
|---|---|---|---|
| 1,517,848 | 12/1924 | McClelland | 362/122 |
| 2,692,374 | 10/1954 | Carson | 362/249 X |
| 3,603,780 | 9/1971 | Lu | 362/123 |
| 3,735,117 | 5/1973 | Hunt | 362/123 |
| 3,737,646 | 6/1973 | Burrows | 362/252 X |
| 4,156,892 | 5/1979 | Fisher | 362/123 |

*Primary Examiner*—Tony M. Argenbright
*Attorney, Agent, or Firm*—Alfred M. Walker

[57] ABSTRACT

A decorative lighting system having individual low voltage incandescent lights mountable upon removal limbs or conductive supports which are interconnected with stems or base supports containing low voltage buried conductors, together with a transformer for reducing electrical output to a low voltage range in a preferred embodiment. The stem or base support comprises a material of a low voltage high density conductive plastic, or a laminated metallic conductor.

11 Claims, 10 Drawing Figures

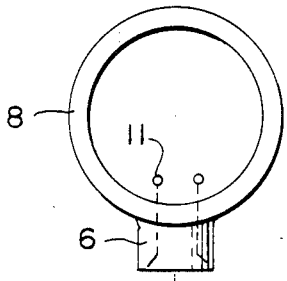
Fig. 3
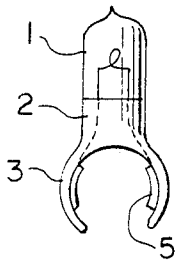
Fig. 1
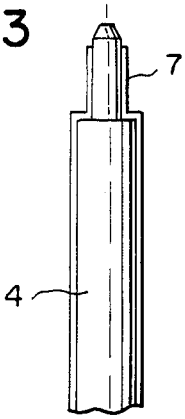
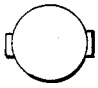
Fig. 4
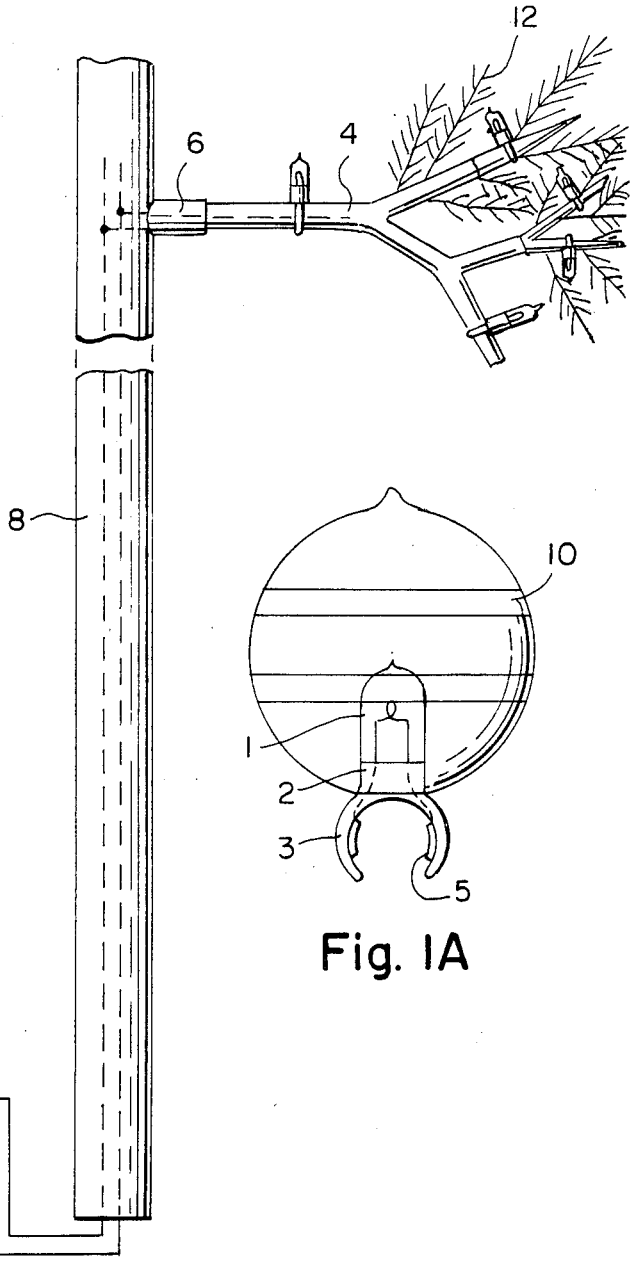
Fig. 2
Fig. 1A

DECORATIVE LIGHTING SYSTEM

This invention relates to a decorative lighting system and in particular, to a mounting apparatus for mounting removable low voltage incandescent lights with spring holding clamps so that the lamps can be randomly placed throughout a decorative lighting system, such as an artificial Christmas tree.

The invention provides a decorative lighting system having individual low voltage incandescent lights mountable upon removable limbs or first conductive supporting members which are interconnected with stems or second base supporting members containing low voltage buried conductors, together with a transformer for reducing electrical output to a low voltage range in a preferred embodiment. The stem or second base supporting member comprises a material of a low voltage high density conductive plastic or a laminated metallic conductor. The light bulbs may be placed randomly at any position throughout the decorative lighting system since they are clamped to limbs or supporting members of the decorative lighting system which are frictionally engaged to said supporting members. Low voltage current is provided by a transformer to a stem or supporting member base comprising buried conductors or a stem made of high density conductive plastic. In a preferred embodiment, the invention comprises individual incandescent lamps mounted upon spring loaded C-shaped clasps which are frictionally engaged to be mounted upon limbs of an artificial Christmas tree. The limbs may be attached by electrical connections so that the limbs are disposed to a buried conductor within the stem of the Christmas tree which is electrically connected to a transformer for reducing the voltage to a low voltage range, preferrably twelve volts or less. In this embodiment, the longitudinal branches or first support members of the Christmas tree are made of a conductive material or may have metallic conductors laminated to them so that the individual lights may be frictionally engaged upon the branch by random placement. This has the advantage of allowing the user to creatively decorate a Christmas tree without being limited to specific locations for Christmas tree lights or by the use of cumbersome and unsightly Christmas tree lighting wherein illumination is provided by plural light sources in a particular arrangement.

In another embodiment of the light, Christmas tree balls which are transparent or translucent may be mounted over the incandescent light bulb to provide lighting from within the ball. In another embodiment of the invention, a Christmas wreath is provided with a low voltage circular conductor to which are attached strands. The user may intermittently and randomly place the Christmas balls throughout the circular conductor.

In another embodiment, a flexible strip acts as a conductor such as a mantel which may be mounted over a door.

In a further embodiment, a plurality of parallel conductor supports are mounted horizontally within a frame so that the incandescent lights may be mounted throughout the frame to spell letters of the alphabet in short readings.

BRIEF DESCRIPTION OF DRAWINGS

To better understand the invention, reference is made to the accompanying drawings which are offered by way of example and which are not to be taken as limiting the invention, taken together with the accompanying drawings in which:

FIG. 1 is a close-up side view of an individual incandescent low voltage light mounted upon a C-Shaped spring device which is frictionally engaged to the conductors of the system.

FIG. 1A is a close-up side elevation view of the incandescent bulb showing a decorative translucent or transparent Christmas ball mounted thereon.

FIG. 2 is a schematic elevational view of the system.

FIG. 3 is a schematic top view showing the connection of first supporting member, such as a branch to the second supporting member, such as a base support of the system.

FIG. 4 is a cross sectional end view of the branch, showing laminated metallic conductors attached thereto.

DESCRIPTION OF PREFERRED EMBODIMENT

Figure 5:
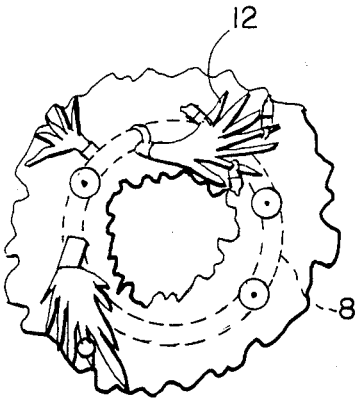
FIG. 5 is a front view of a preferred embodiment of the decorative lighting system in the form of a Christmas tree wreath.

Referring to FIGS. 1–4, there is shown an incandescent light bulb, 1, mounted on a clasp type device 2, comprising a C-shaped spring device having two converging prongs 3 which is frictionally engaged upon a first supporting member, or branch 4. Branch 4 is made of a material which acts as a low voltage conductor wherein the voltage is a safe low voltage or has low voltage metallic conductors laminted thereon. Bulb 1 contains conductive means 5 located within the inner circumferences of C-shaped prongs 3, so as to frictionally engage branches 4. Branches 4 are connected by a coupling device 6 in which a tapered end 7 of branch 4 interconnects with a buried conductor located within a second supporting member, such as stem 8. In a preferred embodiment, stem 8 and branch 4 are made of a high density conductor plastic so that the electrical current may be provided throughout the branches at a safe level. Stem 8 is connected to transformer 9 to prevent surges of electrical current above a safe level. In another embodiment of the invention, bulb 1 is encased within a translucent or transparent Christmas ball 10.

Branches 4 are connected to female electrical contacts 6 which engage electrical contacts 11 within stem 8. However, as aforementioned, stem 8 may comprise the electrical conductive material itself so that female contact 6 attaches directly to the exterior portion of stem 8. Tapered end 7 of branches 4 fits snugly within female contact 6 of the device. Branch sections 4 are shaped with projections 12 which simulate Christmas tree fir branches extending from branch 4.

Clasps 2 contain C-shaped prongs 3 having a circular tension so that prongs 3 will fit snugly over branch 4 while maintaining electrical contact.

Figure 6:
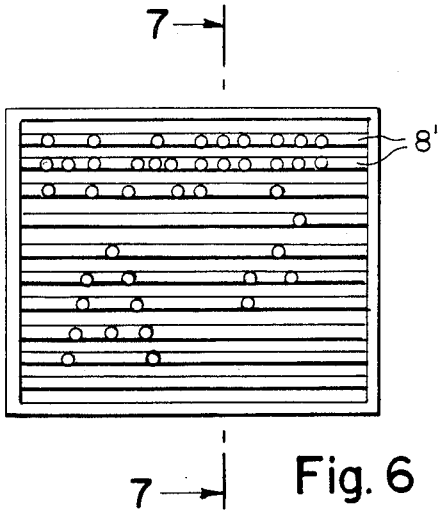
FIG. 6 is a front view of a preferred embodiment showing a plurality of horizontal parallel supports.

Referring to FIGS. 5, 6, 7, 8, 9, alternative designs are provided for the decorative lighting system. In FIG. 5, stem 8 is provided in a circular form so that fir branches 12 may be mounted to simulate a Christmas wreath upon which the Christmas lights 1 may be frictionally engaged upon stem 8. FIG. 6 shows a different form of the invention wherein a plurality of parallel horizontal stems 8' is provided on which bulbs 1 are frictionally mounted. In this manner, letters of the alphabet may be written to provide short slogans or initials in a decorative fashion. Stems 8' are mounted upon a support 13 which contains a buried conductor to which bulbs 1 make contact with, or which is made of a high density conductive plastic to conduct the current to bulbs 1 mounted upon stems 8'.

Figure 8:
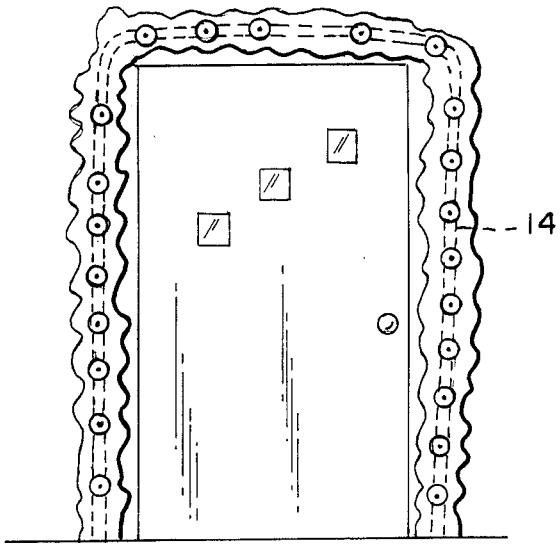
FIG. 8 is a front view of a preferred embodiment showing the system as a mantel over a door.
Figure 7:
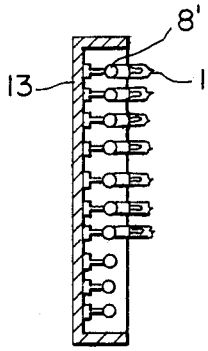
FIG. 7 is a cross sectional view taken along line 7—7 of FIG. 6.
Figure 9:
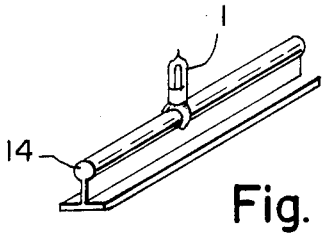
FIG. 9 is a perspective close-up view of the incandescent bulb mounted upon a support as shown in FIG. 8.

In another embodiment as shown in FIGS. 8 and 9, a flexible tube-like stem 14 is provided upon which bulbs 1 are mounted. In this manner, a decorative lighting system in the form of a door mantel may be provided. Branches 4 may be manually removed from the female contact 6 located on stem 8 for easy storage of the decorative lighting system when not in use. Because of the spring loaded configuration of support 2 for light 1 containing C-shaped prongs 3, lights 1 are easily mounted and dismounted from branches 4.

As several specific embodiments of the present invention have been illustrated, it is to be understood that many changes and modifications thereof can be made without departing from the spirit of the invention as defined in the following claims.

What is claimed is:

1. A lighting system for conducting an electrical current to lamps disposed on ornamental objects comprising:

elongated support track means having a pair of separated first electrical conductors separately disposed along its length; and lamp means having C-shaped resilient clasp means including a pair of separately disposed second conductors connected to said lamp means, said second conductors having an alignment corresponding to said first conductors for frictionally engaging said support track means and electrically connecting said first conductors to said second conductors and said lamp means, said second conductors are flat conductors each disposed in the resilient C-shaped clasp means for making surface contact with said first electrical conductors.

2. The lighting system as recited in claim 1, wherein said elongaged support track means comprises at least one artificial branch of a Christmas tree.

3. The lighting system as recited in claim 2, additionally comprising an artificial tree trunk having a plurality of socket openings disposed around its periphery and along its length for electrically connecting each of said tree branches to a source of electrical current.

4. The lighting system as recited in claim 3, wherein each of said openings of said tree trunk include electrical sockets for frictionally engaging the ends of said tree branches.

5. The lighting system as recited in claim 1, wherein said elongated support track means comprises a plurality of parallel, spaced-apart tracks and additionally comprising a support frame mechanically joining and supporting the ends of all of said tracks.

6. The lighting system as recited in claim 1, wherein said track means comprises a U-shaped door mantel having at least one end electrically coupled to said electrical current.

7. The lighting system as recited in claim 1, wherein said track means comprises a closed circle and wherein said first electrical conductors include means for connecting the conductors to an electrical current.

8. The lighting system as recited in claim 1, additionally comprising a transformer connected to the electrical current for reducing the voltage supplied to said lamp means through said track means.

9. The lighting system as recited in claim 1, wherein said track means comprises a flexible longitudinal length of conductive material.

10. The lighting system as recited in claim 3, wherein said tree trunk includes a buried electrical conductor disposed along its length and connected to each of the openings disposed along the length of the tree trunk.

11. The lighting system as recited in claim 1, wherein said track means and said clasp means comprise high density conductive plastic capable of conducting low voltage current.

* * * * *